US006733004B2

(12) United States Patent
Crawley

(10) Patent No.: US 6,733,004 B2
(45) Date of Patent: May 11, 2004

(54) APPARATUS FOR GENERATING FOAM

(76) Inventor: Harry Crawley, Box 236A, R.R. #2, Dugald, Manitoba (CA), R0E 0K0

( * ) Notice: Subject to any disclaimer, the term of this patent is extended or adjusted under 35 U.S.C. 154(b) by 13 days.

(21) Appl. No.: 10/061,353

(22) Filed: Feb. 4, 2002

(65) Prior Publication Data

US 2003/0146522 A1 Aug. 7, 2003

(51) Int. Cl.[7] ..... B01F 3/04

(52) U.S. Cl. ..... 261/18.1; 261/64.1; 261/66; 261/DIG. 26; 169/14; 169/44

(58) Field of Search ..... 261/18.1, 37, 64.1, 261/66, DIG. 26; 169/14, 15, 44

(56) References Cited

U.S. PATENT DOCUMENTS 4,981,178 A * 1/1991 Bundy
5,232,052 A * 8/1993 Arvidson et al.
5,291,951 A * 3/1994 Morand
5,313,548 A * 5/1994 Arvidson et al.
5,411,100 A * 5/1995 Laskaris et al.
5,582,776 A 12/1996 Crawley et al.
6,009,953 A * 1/2000 Laskaris et al.

* cited by examiner

*Primary Examiner*—Scott Bushey
(74) *Attorney, Agent, or Firm*—Adrian D. Battison; Ryan W. Dupuis; Michael R. Williams

(57) ABSTRACT

Foam for suppressing fires is formed by mixing together a constant stream of compressed air and water from a pump at a controlled rate with a quantity of a foaming agent from a foaming agent supply proportional to the rate of flow of water so as to be incorporated therein. An agitator mixes the water and the foaming agent into the stream of compressed air to generate the foam. The rate of flow of the water is controlled by a continuously variable valve member driven between five set positions by an electronically controlled motor including a fully open position, in which a maximum flow rate of the water is supplied to the mixer with the proportional quantity of a foaming agent, a fully closed position, in which the flow of water and the flow of a foaming agent from the foaming agent supply are halted, and at least three intermediate positions of different foam characteristics.

13 Claims, 2 Drawing Sheets

FOAM DISCHARGE SYSTEM
13
NEGATIVE (-)
POSTIVE (+)
WATER SUPPLY
11
29
28
27
26
30
16
17
18
12B
FOAMING AGENT SUPPLY 2
12
19
FOAMING AGENT SUPPLY 1
12A
25
20
23
15
14
COMPRESSED AIR SUPPLY
10
21
22
17

APPARATUS FOR GENERATING FOAM

This invention relates to an apparatus for the production of foam for the purpose of fire prevention and suppression.

BACKGROUND OF THE INVENTION

For some time foaming agents have been used to increase the effectiveness of water in the prevention and suppression of fires. Systems have traditionally used foaming agents, commonly known as surfactants, mixed in holding tanks or introduced into the water stream by a variety of methods. More recently systems have been developed which also provide for the injection of compressed air into the water/surfactant mixture to provide an improved quality and volume of foam.

In U.S. Pat. No. 5,582,776 of the present inventors issued Dec. $10^{th}$ 1996 is disclosed a portable apparatus for generating foam. The apparatus disclosed was particularly directed at an apparatus for making compressed air foam to be used in stationary or portable fire fighting systems and emergency response units. The system is particularly applicable to portable systems used in forestry, structure protection, rural and urban grass fires (Class A fires), and oil and gas fires (Class B fires).

The arrangement shown in the above patent was particularly designed as a portable unit for use in remote locations. However attention is necessary to provide a more enhanced unit which can more effectively control the supply of foam of a required characteristic particularly for use in situations where the foam must be more accurately controlled for different characteristics of the fire to be controlled.

SUMMARY OF THE INVENTION

It is one object of the present invention to provide an improved apparatus and method for generating foam which is more convenient for the operator and allows simple control of the system to generate the required characteristic of foam consistently.

According to one aspect of the invention there is provided an apparatus for generating foam comprising:

- a source of compressed air under pressure arranged, when actuated, to provide a stream of the compressed air at a predetermined rate;
- a pump for pumping a liquid to be foamed having a pump inlet for connection to a liquid supply and a pump outlet;
- a supply line connected to the pump outlet for receiving a flow of the liquid therefrom;
- an injector connected into the supply line and arranged for supplying to the supply line a quantity of a foaming agent from a foaming agent supply proportional to the flow of liquid so as to be incorporated therein;
- a mixer for feeding the liquid and the foaming agent incorporated therein from the supply line into the stream of compressed air and for mixing the liquid, foaming agent and compressed air to generate the foam;
- and a control valve for controlling the rate of flow of the liquid in the supply line to the mixer comprising:
  - a continuously variable valve member movable between a fully open position, in which a maximum flow rate of the liquid is supplied to the mixer with the proportional quantity of a foaming agent from the foaming agent supply, and a fully closed position, in which the flow of liquid and the flow of a foaming agent from the foaming agent supply are halted, and continuously variable therebetween;
  - a motor for driving the valve member between the fully open and fully closed positions;
  - an electronic control for controlling operation of the motor, the electronic control having a plurality of set positions corresponding to set positions of the motor and the valve member;
  - the set positions including the fully open position, the fully closed position and at least three intermediate positions.

According to a second aspect of the invention there is provided a method for generating foam comprising:

- providing a stream of compressed air at a predetermined rate;
- pumping a liquid to be foamed from a liquid supply and supplying the liquid at a pump outlet;
- providing a supply line connected to the pump outlet for receiving the flow of the liquid therefrom;
- providing an injector connected into the supply line and supplying to the supply line from the injector a quantity of a foaming agent from a foaming agent supply proportional to the flow of liquid so as to be incorporated therein;
- providing a mixer for mixing the liquid and the foaming agent incorporated therein from the supply line into the stream of compressed air to generate the foam;
- and controlling the rate of flow of the liquid in the supply line by:
  - providing a continuously variable valve member movable between a fully open position, in which a maximum flow rate of the liquid is supplied to the mixer with the proportional quantity of a foaming agent from the foaming agent supply, and a fully closed position, in which the flow of liquid and the flow of a foaming agent from the foaming agent supply are halted, and continuously variable therebetween;
  - driving the valve member between the fully open and fully closed positions by a motor;
  - and controlling operation of the motor by an electronic control, the electronic control having a plurality of set positions corresponding to set positions of the motor and the valve member;
  - the set positions including the fully open position, the fully closed position and at least three intermediate positions.

As the amount of foaming agent is added in direct proportion to the amount of water, the valve may be used to control the flow rate of only the water, in which case the foaming agent is added downstream of the valve; or the foaming agent is added upstream of the valve and the valve used to control the flow rate of the mixture.

Preferably the electronic control includes a display for displaying to an operator the set position selected. This can be a screen or a series of LEDs.

Preferably the display displays the fully open position, the fully closed position and for each of the intermediate positions information relating to the wetness characteristics of the foam.

On one arrangement, the electronic control includes a single switch which is manually operable repeatedly such that each operation acts to cycle from one set position to the next. Alternatively, a series of individual switches can be used each associated with a respective one of the set positions and each having a respective display LED.

Preferably, when the valve is moved to the fully open position, the stream of compressed air is halted and a form and amount of foaming agent suitable for non-compressed air foam is used.

Preferably the three intermediate set positions are determined by measuring a rate of liquid flow from the valve member and by adjusting the respective set position to provide a predetermined flow rate.

BRIEF DESCRIPTION OF THE DRAWINGS

One embodiment of the invention will now be described in conjunction with the accompanying drawings in which.

DETAILED DESCRIPTION

Figure 1:
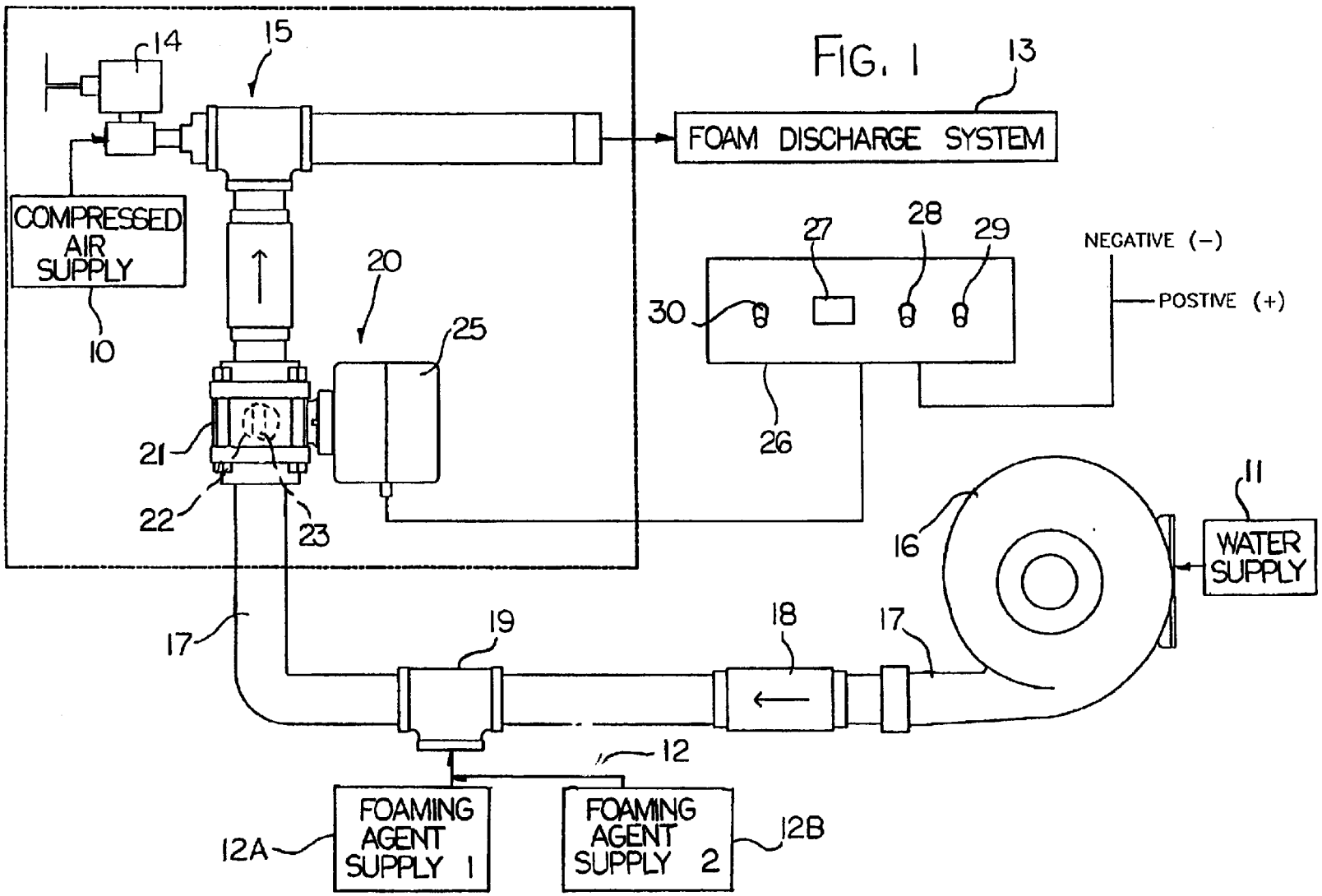
FIG. 1 is a schematic illustration of the apparatus according to the present invention.

The apparatus as shown for generating foam is shown in FIG. 1 and includes a compressed air supply 10, a water supply 11, a foaming agent supply 12 and a foam discharge system 13 by which the foam is applied to the location required.

The system further includes a control valve 14 which controls the supply of the compressed air from the compressed air supply 10 to a mixer 15 which is of the construction shown in the above patent. The water from the water supply 11 is supplied to a pump 16 which generates water flow in an output line 17. The water passes through a back check valve 18. An injector 19 of the type shown in the above patent adds to the water in the line 17 an amount of foaming agent proportional to the waterflow. Thus the injector 19 is responsive to the water flow and adds the quantity of foaming agent necessary to match that water flow at the required ratio which is constant for all waterflow rates. The supply 12 of foaming agent includes a first supply 12A and a second supply 12B for different types of foaming agent.

The flow rate within the duct 17 is controlled by a valve generally indicated at 20. The valve comprises a ball valve 21 which has a ball schematically indicated at 22 with an orifice 23 so that rotation of the ball varies the amount of the orifice accessible to the line 17 from 0 up to 100% thus continuously variably adjusting the flow rate from fully off to fully on. The ball is rotated through 90° by a motor 25 controlled by an electronic control system 26. A commercially available valve, motor and control unit is available and is suitable for use in an arrangement of this type.

The motor is thus a motor which drives the ball valve from fully closed to fully open through a series of pre-selected steps of the motor. A suitable commercially available device uses a potentiometer feed-back system which allows specific points on the potentiometer to be selected and the motor operated to move to those pre-selected positions of the potentiometer. The electronic controller 26 includes a display 27, setting switches 28 and 29 and a single operating switch 30.

In operation, the flow rate of water and foaming agent necessary to generate certain characteristics of foam is previously determined. Thus three different characteristics of foam can be formed with the following ratios:

Dry
2 cfm air
1 US Gallon/min water
0.2 to 0.4% of foaming agent relative to the amount of water;

Wet
1 cfm air
1 US Gallon/min water
0.2 to 0.4% of foaming agent relative to the amount of water;

Extra Wet
1 cfm air
2 US Gallon/min water
0.2 to 0.4% of foaming agent relative to the amount of water;

The control unit is therefore operated to select positions of the operation of the motor determined to provide the above three flow rates as measured at the output 13 in the absence of compressed air so that the volume of liquid flowing is accurately determined and adjusted by the set switches 28 and 29.

With the controller so set, the controller is arranged such that each operation of the operating switch 30 cycles the system through each of the five conditions in turn that is fully closed, dry, wet, super wet and fully open in turn with a further actuation of the switch returning the system to the fully closed position.

Thus with the system set to cycle in this manner and with the set positions selected at the locations of the motor so as to provide the accurately measured required flow rate, the compressed air supply is activated and the control switch 30 operated to supply the required quantity of water.

The control unit is further arranged so that when the control switch is operated to the fully closed position, the compressed air supply is also deactivated so that the system is off.

The control unit is also arranged so that when the cycling switch 30 moves the control of the pump to the fully opened position, the compressed air supply is also switched off. At the same time the foaming agent from the supply 1 which is used with the compressed air foam is replaced with other foaming agents on supply 2 which can be used for foaming only water so that when the water supply is on full, no compressed air is added and the foaming agent from the supply 2 acts in the mixer to generate the required foam. In some cases, depending upon the type of foaming agent used, and many are available, the same foaming agent may be used for both functions with the amount being increased approximately three-fold for the non-compressed air foam.

Figure 2:
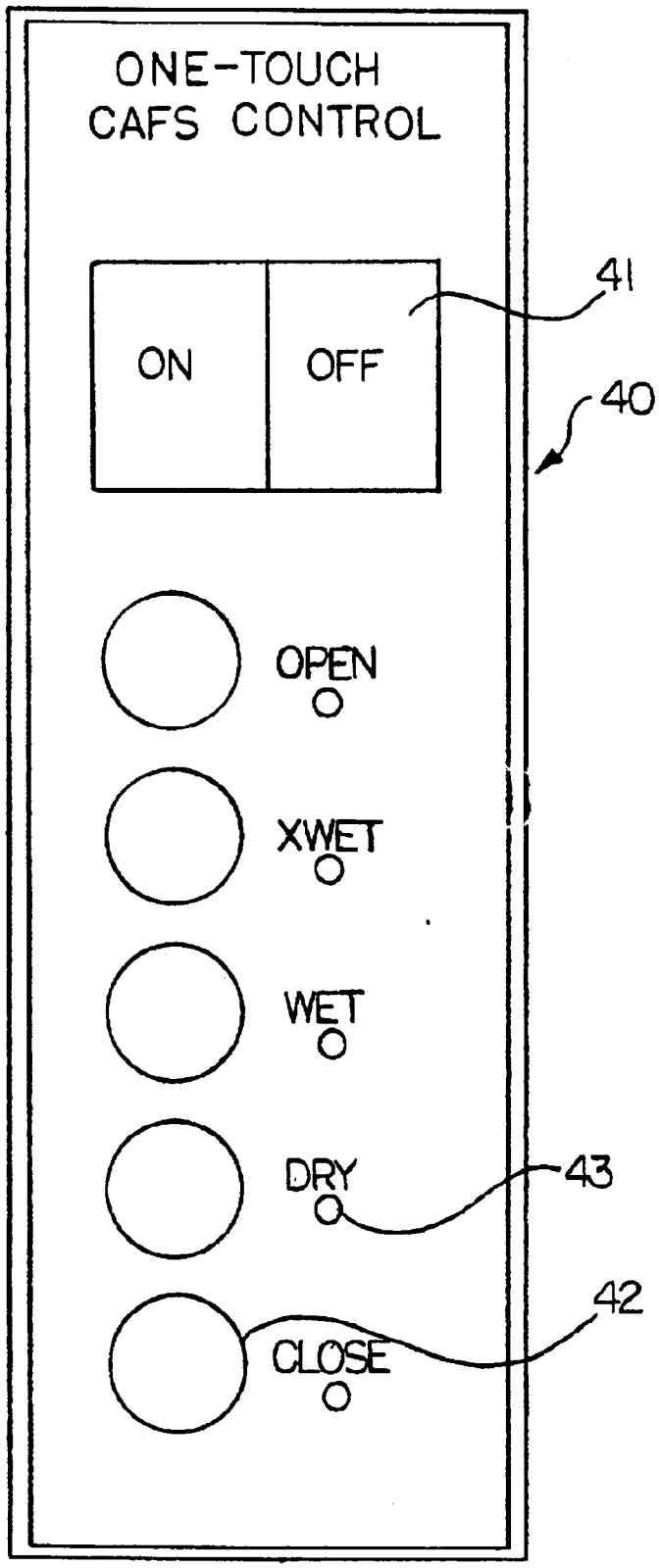
FIG. 2 is a front elevational view of a second switching device for use with the apparatus of FIG. 1.

In FIG. 2 is shown an alternative control unit 41 which includes a single pole two position on-off switch 40 and five momentary switches 42 each of which provides a pre-set for the conditions previously stated. Each switch 42 is associated with a respective LED 43 which is illuminated to indicate to the user the condition which has been selected by depression of the switch concerned.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. Apparatus for generating foam comprising:

a source of compressed air under pressure;

an airflow valve operable to be opened and closed and when opened to provide a stream of the compressed air from the source at a fixed rate of flow;

a pump for pumping a liquid to be foamed having a pump inlet for connection to a liquid supply and a pump outlet;

a supply line connected to the pump outlet for receiving a flow of the liquid therefrom;

an injector connected into the supply line and arranged for supplying to the supply line a quantity of a foaming agent from a foaming agent supply proportional to the flow of liquid so as to be incorporated therein;

a mixer for feeding the liquid and the foaming agent incorporated therein from the supply line into the stream of compressed air and for mixing the liquid, foaming agent and compressed air to generate the foam;

the supply line and the injector being arranged such that all liquid supplied to the supply line from the pump outlet and all foaming agent supplied to the supply line from the injector is supplied to the mixer;

and a control valve for controlling the rate of flow in the supply line comprising:

a continuously variable valve member movable between a fully open position, in which a maximum flow rate of the liquid is supplied to the mixer with the proportional quantity of a foaming agent from the foaming agent supply, and a fully closed position, in which the flow of liquid from the pump outlet and the flow of a foaming agent from the supply injector are halted, and continuously variable therebetween;

a motor for driving the valve member between the fully open and fully closed positions;

an electronic control for controlling operation of the motor, the electronic control having a plurality of set positions corresponding to set positions of the motor and the valve member;

the set positions including the fully open position, the fully closed position and at least three intermediate positions;

the electronic control being arranged to provide control of said rates of flow only in respect of the rate of flow in the supply line by operating the motor of the valve member.

2. The apparatus according to claim 1 wherein the electronic control includes a display for displaying to an operator the set position selected.

3. The apparatus according to claim 2 wherein the display displays the fully open position, the fully closed position and for each of the intermediate positions information relating to the wetness characteristics of the foam.

4. The apparatus according to claim 1 wherein the electronic control includes a single switch which is manually operable repeatedly such that each operation acts to cycle from one set position to the next.

5. The apparatus according to claim 1 wherein the electronic control includes a plurality of switches each of which corresponds to a respective one of the set positions and each of which has associated therewith a respective display light.

6. A method for generating foam comprising:

providing a source of compressed air predetermined rate;

operating an airflow valve when closed to halt flow of compressed air from the source and when open to provide a stream of the compressed air at a fixed rate of flow pumping a liquid to be foamed from a liquid supply and supplying the liquid at a pump outlet;

providing a supply line connected to the pump outlet for receiving the flow of the liquid therefrom;

providing an injector connected into the supply line and supplying to the supply line from the injector a quantity of a foaming agent from a foaming agent supply proportional to the flow of liquid so as to be incorporated therein;

providing a mixer for mixing the liquid and the foaming agent incorporated therein from the supply line into the stream of compressed air to generate the foam;

arranging in the su line and the injector such that all liquid supplied to the supply line from the pump outlet and all foaming agent supplied to the supply line from the injector is supplied to the mixer;

and controlling the rate of flow of the liquid in the supply line by:

providing a continuously variable valve member movable between a fully open position, in which a maximum flow rate of the liquid is supplied to the mixer with the proportional quantity of a foaming agent from the foaming agent supply, and a fully closed position, in which the flow of liquid from the pump outlet and the flow of a foaming agent from the injector are halted, and continuously variable therebetween;

driving the valve member between the fully open and fully closed positions by a motor;

and controlling operation of the motor by an electronic control, the electronic control having a plurality of set positions corresponding to set positions of the motor and the valve member;

the set positions including the fully open position, the fully closed position and at least three intermediate positions;

and operating the electronic control to control said rates of flow by controlling, using said motor, the rate of flow only in the supply line.

7. The method according to claim 6 wherein the electronic control includes a display for displaying to an operator the set position selected.

8. The method according to claim 7 wherein the display displays the fully open position, the fully closed position and for each of the intermediate positions information relating to the wetness characteristics of the foam.

9. The method according to claim 6 wherein the electronic control includes a single switch which is manually operable repeatedly such that each operation acts to cycle from one set position to the next.

10. The method according to claim 6 wherein the electronic control includes a plurality of switches each of which corresponds to a respective one of the set positions and each of which has associated therewith a respective display light.

11. The method according to claim 6 wherein, when the valve is moved to the fully open position, the stream of compressed air is halted.

12. The method according to claim 6 wherein, when the valve is moved to the fully open position, the stream of compressed air is halted and a form and amount of foaming agent is used for use in forming foam without compressed air.

13. The method according to claim 6 wherein the three intermediate set positions are determined by measuring a rate of liquid flow from the valve member and by adjusting the respective set position to provide a predetermined flow rate.

* * * * *